United States Patent [19]

Peterson

[11] 4,348,777

[45] Sep. 14, 1982

[54] PORTABLE SHOWER

[76] Inventor: Guy E. Peterson, Rte. 3, Box 519, Irwin, Tenn. 37650

[21] Appl. No.: 239,475

[22] Filed: Mar. 2, 1981

[51] Int. Cl.[3] ..... A47K 3/22

[52] U.S. Cl. ..... 4/596; 4/597; 4/602; 4/605; 4/616

[58] Field of Search ..... 4/600, 599, 596, 597, 4/602, 604, 608, 612, 616, 624, 662, 661, 663, 664

[56] References Cited

U.S. PATENT DOCUMENTS

| | | | |
|---|---|---|---|
| 3,483,572 | 12/1969 | Hallum | 4/597 |
| 3,668,710 | 6/1972 | Dowd | 4/597 |
| 4,008,496 | 2/1977 | Johansson | 4/597 |

*Primary Examiner*—Henry K. Artis

*Attorney, Agent, or Firm*—Diller, Ramik & Wight

[57] ABSTRACT

This disclosure relates to a portable shower particularly adapted for use at construction sites, campgrounds, industrial plants, truck and auto service stations and the like in which persons can conveniently and efficiently shower, the module including first, second and third compartments within which a person can respectively disrobe, shower and dress, first through third doors for respectively entering the first through third compartments and a fourth door for exiting the third compartment, first through fourth locks associated with the first through fourth doors, a conveyor for conveying clothes placed upon the same in the first compartment to the third compartment, and a control mechanism for operating the conveyor means to move the clothing from the first compartment to the third compartment generally in synchronism with the movement of the person from the first to the third compartment.

29 Claims, 5 Drawing Figures

PORTABLE SHOWER

The present invention is directed to a novel shower or shower modular which is particularly adapted to be utilized temporarily at construction sites, campgrounds, industrial plants, truck and auto service stations and the like.

When, for example, one uses a campground and particularly a so-called "primitive" campground, the barest of amenities are provided and generally excluded from the same are such conveniences as sinks with running water, showers, etc. It would be highly desirable to be able to conveniently shower at such sites, but since most are seasonal, it is generally uneconomical to provide permanent shower facilities. This is not only true of campgrounds but is also true at, for example, construction sites where temporary portable toilets might be provided, while portable showers are not provided, yet the latter is as much in demand as the former.

In keeping with the foregoing, it is a primary object of this invention to provide a novel portable shower module which can be used at any one of a number of different locations, such as construction sites, campgrounds, industrial plants, truck and auto service stations, highway rest stops and the like in which persons can conveniently, efficiently and rapidly shower, the shower module including generally at a minimum three compartments with doors for entering and exiting respective first and third of the compartments in which a person can respectively disrobe and dress, a second of the compartments including a shower, and a conveyor between the first and third compartments operative such that clothing placed upon the conveyor by a person when in the first compartment can be reobtained from the conveyor by the person when the latter reaches the third compartment.

In further keeping with this invention, the novel shower module preferably includes a microprocessor or similar conventional control means for operating the conveyor to move the clothing from the first compartment to the third compartment in general synchronism with the person moving from the first compartment to the third compartment such that another person entering the first compartment can not gain access to the first person's clothing, and the first person's clothing will be available in the third compartment.

Yet another object of this invention is to provide a novel shower module including first through fourth locking means associated with the first through fourth doors respectively, and the control means or microprocessor operate the first through fourth locking means generally simultaneously between locked and unlocked positions whereby the doors are openable generally simultaneously to permit persons to systematically and successively enter, pass through, and exit the first through third compartments.

Yet another object of this invention is to provide a novel shower module of the type aforesaid wherein the control means further includes timer means for holding all of the first through fourth locking means locked for a predetermined period of time and/or for establishing a predetermined total period of time between which a person can remain in any one of the compartments, and means in each compartment responsive to the control means for indicating to a person in any one of the compartments that a particular portion of the total period of time remains before the person is to move from the first, second and third compartments to the second and third compartments and exit the third compartment, respectively.

Yet another object of this invention is to provide a novel shower module of the type described including control means for establishing a predetermined period of time beginning generally with the opening of the first door whereupon a person first enters the first compartment and ending generally with the opening of the fourth door whereupon the same person exits the third compartment through the fourth door.

Still another object of this invention is to provide a novel shower module of the type described including coin operated means for initiating the operation of the control means to establish the predetermined time period, first through fourth locking means for locking and unlocking the first through fourth doors respectively, and the control means being operative generally simultaneously to lock and unlock the first through fourth locking means and the first through fourth doors associated therewith whereby the doors are openable generally simultaneously to permit persons to systematically and successively enter, pass through and exit the first through third compartments.

Still another object of this invention is to provide a novel shower module as described herein including drive means for the conveyor, and a stepping motor for the drive means controlled by the control means whereby the conveyor is stepped during its movement between the first and third compartments generally in synchronism with the movement of a person between the first and third compartments.

With the above and other objects in view that will hereinafter appear, the nature of the invention will be more clearly understood by reference to the following detailed description, the appended claims and the several views illustrated in the accompanying drawings.

IN THE DRAWINGS

Figure 2:
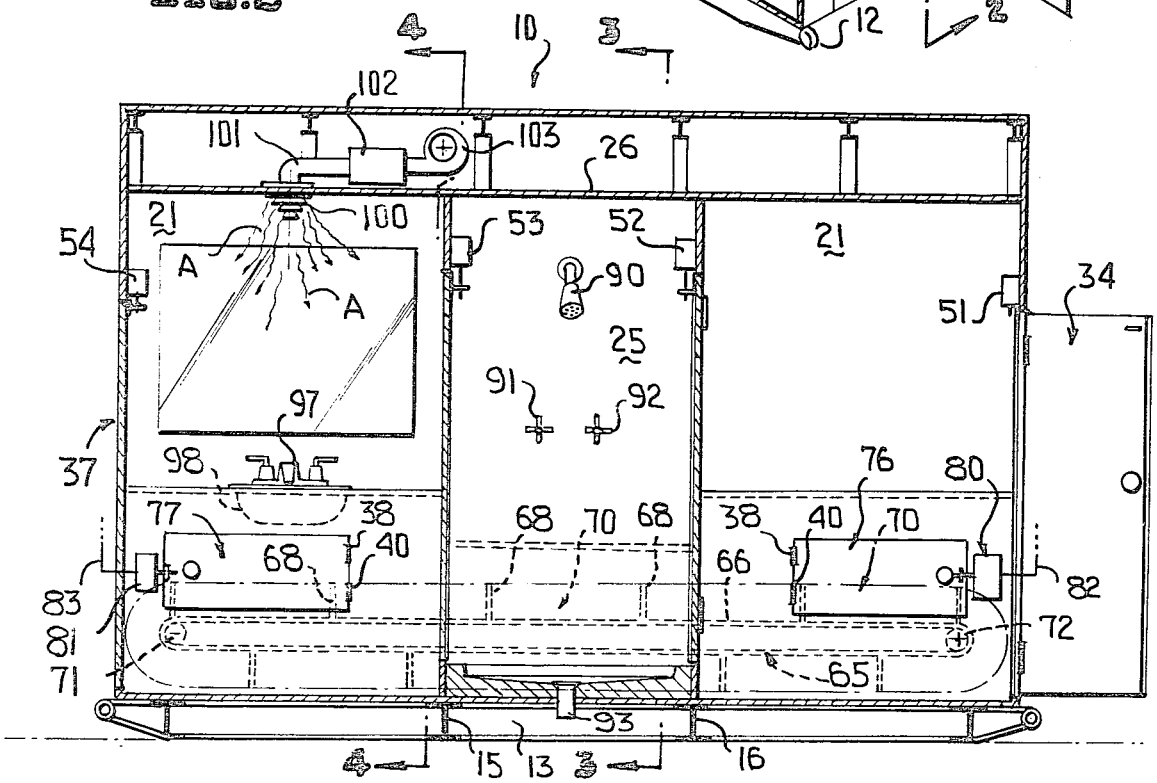
FIG. 2 is a cross-sectional view taken generally along line 2—2 of FIG. 1, and illustrates with more detail the clothes conveyor and doors associated with the latter in the first and third compartments.

A novel shower module constructed in accordance with this invention is generally designated by the reference numeral 10 and includes a bottom wall 11 supported by longitudinally extending skids 12, 13 reinforced by a longitudinal I-beam 14 (FIGS. 3 and 4) and transverse cross-bracing I-beams 15, 16 (FIG. 2). The skids 12, 13 are obviously utilized to permit the shower module to be readily moved from place to place, and thus the same is "portable", although in lieu of the skids 12, 13, the shower module 10 might in fact be supported upon wheels and be towed from site to site by a conventional hitch (not shown) connected to an appropriate vehicle (also not shown).

Figure 1:
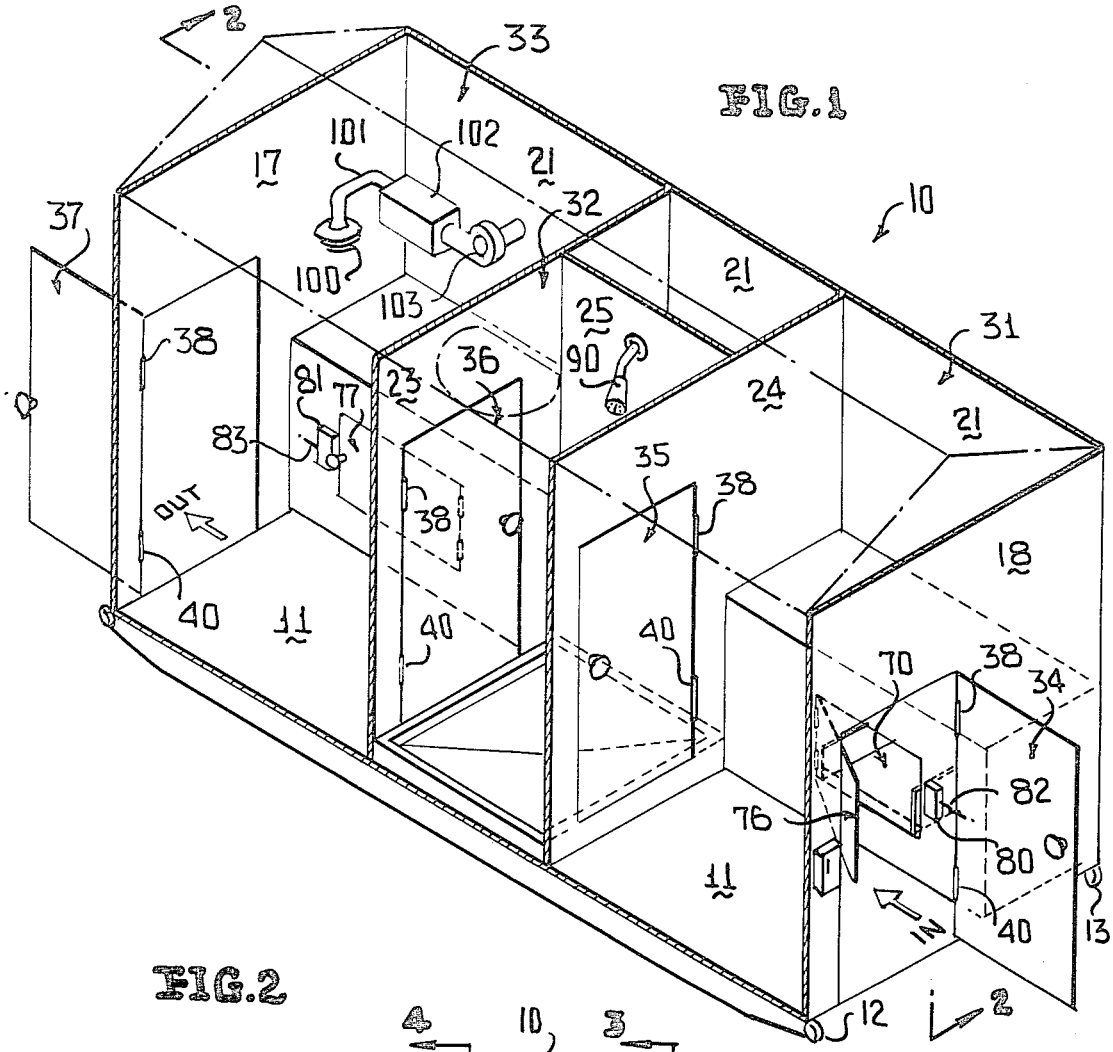
FIG. 1 is a perspective view of a novel shower module of this invention, and illustrates first through fourth doors for entering and exiting first through third compartments, the first through third compartments being utilized for respective disrobing, showering and dressing, and a conveyor for transporting the clothing of a person from the first compartment to the third compartment.

The shower module 10 further includes opposite generally parallel end walls 17, 18, side walls 20, 21, a roof 22 and partitions 23, 24 and 25. The partitions or partition walls 23, 24 are generally parallel to each other and to the end walls 17, 18 and are also generally normal to the partition or partition wall 25 which in turn is generally spaced from and parallel to a portion of the side wall 21 (FIG. 1).

Figure 3:
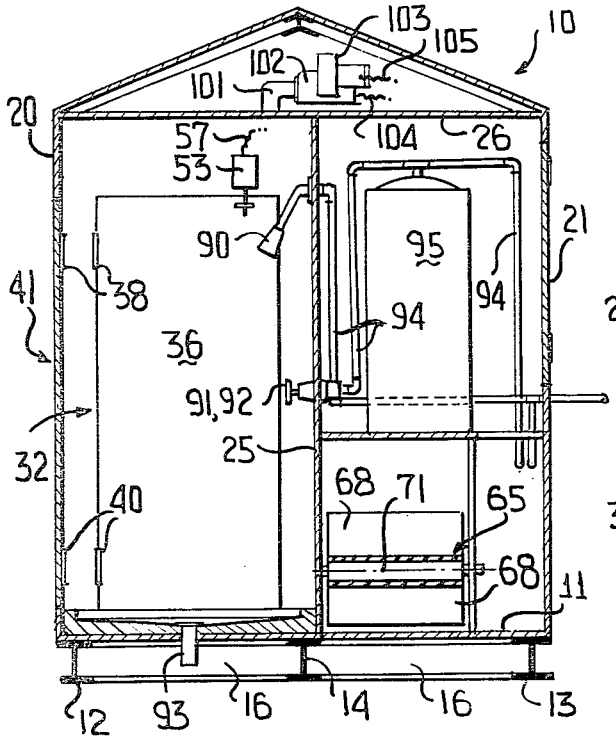
FIG. 3 is a sectional view taken generally along line 3—3 of FIG. 2, and illustrates details of the conveyor and the shower in the second compartment.
Figure 4:
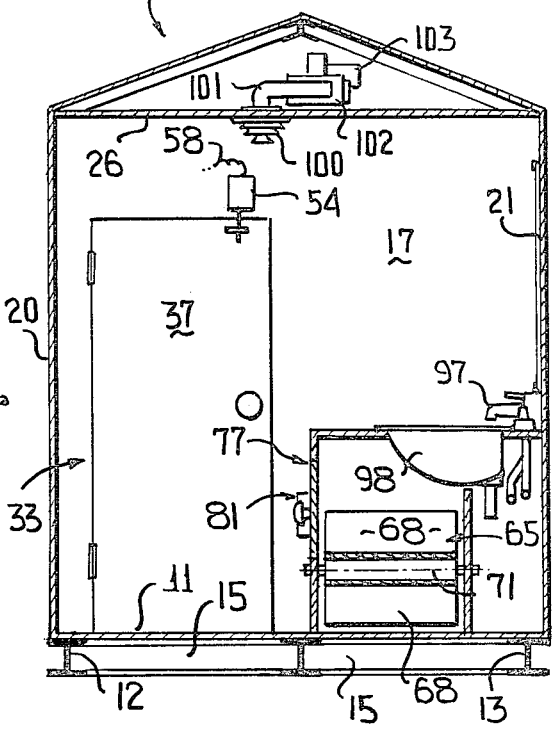
FIG. 4 is a sectional view taken generally along line 4—4 of FIG. 2, and illustrates a wash basin and a heater associated with the third compartment.

A generally horizontal ceiling 26 spans the entire shower module above and generally parallel to the bottom wall 11 (FIGS. 2, 3 and 4).

A first compartment 31 of the shower module 10 is defined by portions of the bottom wall 11, the top wall or ceiling 26, the side walls 20 and 21, the end wall 18, and the partition wall 24.

A second compartment 32 is likewise defined by portions of the bottom wall 11, the top wall or ceiling 26, portions of the partitions or partition walls 23, 24 and the partition wall 25.

A final or third compartment 33 is defined by portions of the bottom wall 11, the top wall 26, portions of the side walls 20, 21, the end wall 17, and the partition wall 23.

Means generally designated by the reference numerals 34 through 37 define doors for opening and closing respective doorways or passages (unnumbered) through which persons can pass to enter the first compartment 31 and thereafter proceed into and through the second compartment 32, the third compartment 33 and exit the latter through the door 37. The door or door means 34 through 37 are of a conventional construction and are mounted for pivoting or hinged movement on conventional hinges 38, 40. A fifth or additional door 41 (FIG. 5) functions as an emergency exit for the second compartment 32 from which a person might exit directly through the side wall 20 to the exterior of the shower module 10 without opening either of the doors 35, 36. The door 41 is, of course, hinged on conventional hinges 38, 40, just as are the doors 34 through 37.

Detector means and locking means 51 through 54 are associated with the respective doors 34 through 37 and the latter are connected by conventional electrical circuitry to conventional control means or a microprocessor 60 housed at a convenient location within the shower module 10. The detector means and the door latching means 51 through 54 perform two functions, namely, (1) the same can detect whether the respective doors 34 through 37 are opened and closed and transmit this information via the circuitry 55 through 58 to the control means 60 and (2) on the basis of commands from the control means or microprocessor 60, conventional solenoids (not shown or numbered) associated with the detecting means, and latching means 51 through 54 are selectively energized or de-energized to lock or unlock the respective doors 34 through 37 in a manner to be described more fully hereinafter. The latching portion of the means 51 through 54 might be, for example, simply a solenoid operating a plunger which is projected when an associated coil is energized to latch in an opening of a latch (shown, but unnumbered) associated with each door 34 through 37, while de-energization of the respective coils causes the latching plungers to be retracted under the influence of springs to unlatch the plungers from the door latches, and thus render the doors 34 through 37 openable.

Figure 5:
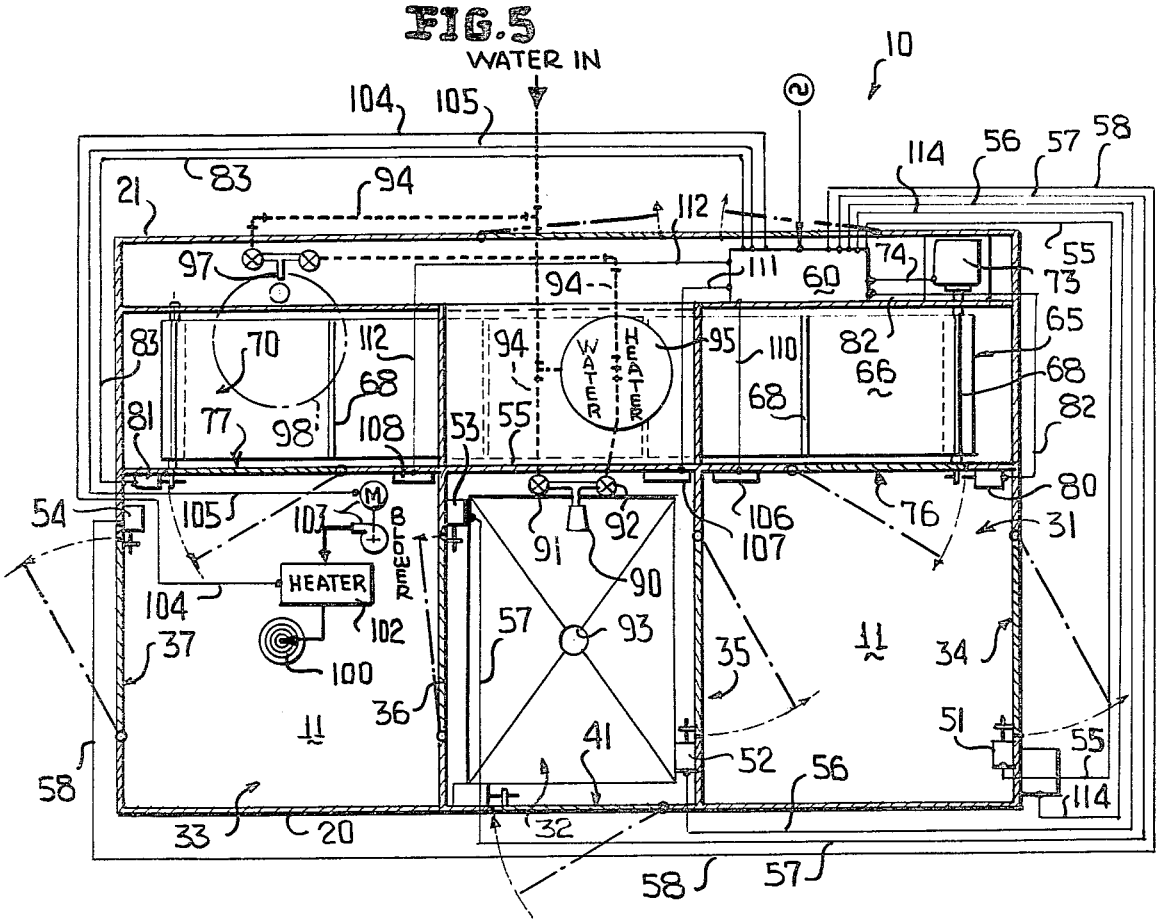
FIG. 5 is a horizontal cross-sectional view looking downwardly from the top of the shower modules in FIGS. 1 and 2, and illustrates locks for all of the doors, a stepping motor for the conveyor, and the control means for sequentially and systematically operating the shower module.

Conveyor means generally designated by the reference numerral 65 is provided within the shower module 10 and extends between the first compartment 31 and thrid compartment 33, as is best illustrated in FIGS. 2 and 5 of the drawings. The conveyor means or conveyor 65 is an endless belt conveyor having an upper run 66, a lower run 67 and transversely extending upstanding bars 68 between adjacent pairs which are defined clothes receiving pockets 70. The conveyor 65 is entrained about an idle pulley 71 and a drive pulley 72 both of which are journalled for rotation in a conventional manner. The drive pulley 72 is connected to a stepping motor 73 which is in turn connected by suitable electrical circutry 74 to the control means 60 (FIG. 5). Access to the conveyor means 65 is provided in the first and third compartments, 31 and 33, respectively, by means of door means or doors 76, 77, respectively. The doors 76, 77 are hinged by conventional hinges 38, 40 and may be swung between their opened and closed positions as indicated respectively in phantom outline and solid lines in FIG. 5. Detecting means and latching means 80, 81 are associated with the doors 76, 77, respectively, and the means 80, 81 are identical to the means 51 through 54 heretofore described and, of course, electrical circutry 82, 83 associated with respective detecting means and latching means 80, 81 are connected to the control means 60 to detect the open and/or closed positions of the doors 76, 77 and latch or unlatch the same. As will be described more fully hereinafter, the purpose of the door 76 is to permit a person within the first compartment 71 to disrobe, place his clothing within one of the pockets 70 of the conveyor means 65 when the door 76 is opened, close the door 76, and proceed through the second compartment 32 and thence to the third compartment 33 from which the person's clothes can be removed when the door 77 is opened after, of course, the conveyor means 65 has transported that person's clothes or clothing to the third compartment 33, again in a manner which will be described more fully hereinafter, particularly in conjunction with FIG. 5 of the drawings.

The compartment 32 is provided with an appropriate shower head 90 which is controlled by handles 91, 92 which control the hot and cold water in a conventional manner. If the system utilizes a built-in conventional regulator, the handles 91, 92 can be eliminated and in lieu thereof there might simply be two push buttons, one for soapy water and the second for rinse water, the temperature both being regulated in a conventional manner. In either event, once the person has showered in the compartment 32, the used water is removed therefrom through a conventional drain 93. The shower head 90 along with the handles 91, 92 are part of a conventional water system including pipes selectively designated by the reference numeral 94 (FIG. 5) and a hot water heater 95, all of which are supplied water from a conventional source of water (not shown). The same pipes 94 are connected to a conventional faucet 97 associated with a sink 98 in the third compartment into which a person enters after showering in the second compartment 32.

The primary purpose of the third compartment 33 is to permit a person having once showered to dry and again dress, and insofar as the latter is concerned, the overall system of FIG. 5 to be described hereinafter assures that the same persons clothes deposited in the pocket 70 when the latter person was in the first compartment 31 will be adjacent the door 77 of the third compartment 33 when this person is in the third compartment 33. At that time, such person will simply open the door 77, remove his clothes therefrom and dress after, of course, being dried by hot air A emanating through an appropriate ceiling duct 100 through a pipe 101 having therein a hot air heater 102 fed ambient air by a conventional electrically operated fan 103. The resistance elements (not shown) of the heater 102 are connected by electrical circuitry 104 to the control means 60 as are the leads or electrical circuitry 105 of the fan 103.

There is also associated with each of the compartments 31 through 33 respective means 106 through 108 which are visual indicators for advising the person in the particular compartments of the particular amount of time that person may spend in that particular compartment or the particular amount of time remaining from the time the person entered into the first compartment 31 through the door 34 until such time as the person must exit through the door 37. The particular indicia which appears on the means 106 through 108 appears on the particular mode of operation of the shower module 10 as dictated by the particular control means 60 which is also utilized to transmit signals to the means 106 through 108 through appropriate electrical circuitry 110 through 112, respectively. The means 106 through 108 might be, for example, an alphanumeric display which might initially register the total time allotted a person to pass through the shower module 10 in which case there will be a simultaneous timewise "countdown" displayed on each of the means 106 through 108 as the person passes from the first compartment 31 to the second compartment 32 to the third compartment 33 and then exits the latter. As an alternative to the latter, the means 106 might simply display the amount of time a person can spend in the compartment 31 which can, depending upon the mode of operation of the control means 60, be less than or equal to the time spent in the compartments 32 and 33, and these would likewise have readouts indicating the time allotted for the person in each individual compartment as opposed to the total time for passing through all three compartments. Obviously, another possibility of the means 106 through 108 is simply that each includes a green, amber and red display indicating respectively that there is time remaining within the particular compartment in which the person is located, that essentially most of the time has lapsed and that persons should ready himself for leaving this compartment, and finally that the person must necessarily leave and move on. Irrespective of the particular mode of operation, the same is begun by the insertion of a coin into a conventional coin operated mechanism 113 adjacent the door 34 which is connected by appropriate electrical circuitry 114 to the mini processor or control means 60.

OPERATION

In its rudimentary form, the shower module 10 need not include any of the circuitry, control means, motor, detectors, etc. heretofore described and might, for example, simply operate under one control, that being a person inserting an appropriate amount of money in the coin operating mechanism 113. Assuming that all of the locking means except the locking means 51 are manually controlled and that all of the doors are normally spring biases closed and latched, a person would first insert a predetermined number of coins in the coin operated mechanism 113 and this simply would open the latch mechanism or means 51 under the direct control of the coin operated mechanism 113 or indirectly through a very simple control means 60. At this point the person would open the door 34, close the same behind him, manually latch the latching mechanism 51, and disrobe. An "occupied" display (not shown) associated with the coin operated mechanism 113 would indicate to another person that such other person could not enter the compartment 31 until the person therein has entered the compartment 32.

An alternate to the latter is, of course, a tie-in between the means 51 and 52 such that the control means 60 would not permit the unlatching of the means 51 by a person inserting coins in the coin operating mechanism 113 until the person in the compartment 31 has entered the compartment 32 and the door 35 has been closed. The closing of the door 35 would then be detected by the means 52 which would, of course, also lock the door 35, and would signal the control means 60 that the person who was originally in the compartment 31 is now in the compartment 32, thus freeing the compartment 31. An appropriate signal from the control means 60 over the line 114 and the line 55 would then condition both for operation to permit a person to enter the compartment 31 while the first person herein described was in the compartment 32.

The person first entering the compartment 31 would then manually unlatch the means 80, open the door 76, and place his or her clothing atop the upper run 66 of the conveyor means 65 and the pocket 70 most closely adjacent the door 76. Obviously, the conveyor means 65 need not be driven nor need it be an endless belt and in any event, it need be any type of a conveying mechanism which can be manually moved to convey the clothing from the position adjacent the door 76 into the third compartment 33 adjacent the door 77. However, again this is preferably accomplished automatically, as will be described more fully hereinafter. After the door 76 has been closed and the clothing moved by the conveying means 65 to the third compartment 33, the person opens the door 35, enters the compartment 32, closes the latch 52, and showers by utilizing the handles 91, 92 or the push buttons (soapy water and rinse water) in the manner heretofore described. Once this is accomplished, the person in the compartment 32 opens the door 36, proceeds into the compartment 33, and might simply throw a switch (not shown) associated with the conductors 104, 105 to energize the resistance heater 102 and start the fan 103 emitting hot air from the duct 100 to dry the person in the compartment 33. Once the person in the compartment 33 is dried, he can then simply unlatch the latching means 81, withdraw his clothing from the then opened door 77, dress and depart through the door 37.

In another mode of operation, the conveyor means 65 might also be moved manually while the coin operated mechanism 113 with or without the computer means 60 will initially unlatch the latching means 51 and then time down from a predetermined time period through a timing mechanism of a conventional construction which is part of the coin operated mechanism 113 or the control means 60. For example, if a timer was incorporated in a coin control mechanism or the control means 60, a person would first insert money in the coin controlled mechanism 113 and this would start a timing out from a predetermined time period as, for example, thirty minutes. In other words, from the time a person inserts the necessary coins in the mechanism 113, he has thirty minutes to proceed through the compartments 31 through 33 and exit the door 37. Obviously, appropriate instructions exteriorly of the door 34 in the vicinity of the mechanism 113 would so advise the person, and once entering and closing the door 34, the time display or alpha display mechanism 106 would indicate in progressively decreasing alphanumeric displays the time remaining, and this would continue by the displays of the mechanisms 107 and 108. Obviously, when the timer times out, the person should have or should be about to leave the third compartment 33 through the door 37 since this timing out would then recondition the mechanism 113 such that coins inserted therein would unlatch the mechanism 51 and permit another person to begin utilizing the shower module 10.

In a preferred embodiment of the present invention, the various detecting means and latching means 51 through 54, 80 and 81, the alphanumeric displays 106 through 108, the coin operated means 113, the heater 102, the blower 103, and the motor 73 are all operated sequentially under the operation of the control means or mini processor 60, and the latter operation is as follows:

Assuming that all of the doors 34 through 37, 76 and 77 are closed and the latches associated therewith are latched, a person who wishes to shower in the shower module 10 first inserts a predetermined number of coins (or bills) in the coin operated (or paper money operated) mechanism 113. An impulse over the line 114 conditions the control means 60 to thereafter control the entire operation of the shower module 10 by first directing an impulse over the line or conductor 55 to energize the coil (unnumbered) associated with the latching means 51 to permit the door 34 to be opened. When the door 34 is opened, the person then enters the compartment 31 and closes the door 32 and this closing is sensed or detected by the detecting and latching means 51 and transmitted via the line 55 to the control means 60. At this point, it is assumed that the control means or mini processor 60 has been programmed for a thirty minute cycle of a person through the three compartments 31 through 33 broken down to ten minutes in the compartment 31 for disrobing or undressing, ten minutes in the compartment 32 for washing showering and/or rinsing and ten minutes in the compartment 33 for drying, redressing and exiting. The control means 60 over the electrical circuitry 110 through 112 places an alphanumeric display of thirty minutes on the means 106 through 108, and the latter, of course, automatically times out toward zero simultaneously on all of the displays 106 through 108. At the same time that the latch means 51 is energized or locked, the latch means 80 is de-energized or unlocked by an impulse from the control means 60 over the electrical circuitry 82. Thus, the person within the compartment 31 can now disrobe, open the door 76, place his clothing upon the upper run 66 of the conveyor means 65 and within the pocket 70 adjacent the door 76, and thereafter close the door 76 with the closing thereof being sensed by the detector means of the detecting and latching means 80. An impulse from the detecting means 80 over the electrical circuitry 82 is delivered to the computer means 60 which travels over the line 74, energizes the motor 73 to advance the conveyor means 65 to a position at which the pocket having the person's clothing therein is adjacent the compartment 32 after which the stepping motor 73 stops as does, of course, the upper run 66 of the conveyor 65. The latter preferably occurs generally simultaneously with the initial ten minutes of the thirty minute cycle timing out, and approximately at this same time (ten minutes) impulses are sent over the lines of circuitry 56, 57, 58 to unlatch the respective latching means 52, 53, and 54. This, obviously, permits the person in the compartment 31 to open the door 35 and enter the compartment 32. The same obviously allows any preceeding person in the compartment 32 to open the door 36 and enter the compartment 33, and likewise permit the person who is in the compartment 33 to open the door 37 and exit the latter. After the person has entered the compartment 32, the door 35 is closed and the closing thereof, as well as the closing of either or both of the doors 36, 37 is sensed by the respective sensing means 52, 53 and 54, and this fact is communicated to the control means 60 via the circuitry 56, 57 and 58. The signal of the opening and closing of the door 35 by the detecting means 32 as transmitted over the circuitry 56 is interpreted by the control means 60 to obviously mean that the compartment 31 is empty, and thus the control means reconditions the coin operated mechanism 113 over the circuitry 114 to accept further coins or bills and, thus, reinstitute a second cycle any time after the first ten minutes have timed down and/or the person in the first compartment 31 has moved into the second compartment 32 which, again, is recognized electrically by the opening and closing of the door 35 as detected by the detecting means 52.

When the person enters the compartment 32, the alphanumeric display 107 might, for example, indicate twenty or less minutes remaining, ten or less which will be utilized by the person in the compartment 32 for washing, showering and rinsing in the manner heretofore described. At this point, it is to be noted that the door 41 is utilized only in cases of emergency to permit a person to exit the compartment 32 by simply manually opening the latch associated with the door 41. This is a safety feature provided even though any of the latching means 51 through 54 can be manually overridden in the event that, for example, there is a malfunction in the water heating system and only cold, extremely hot or scalding water issues from the nozzle 90. Under such conditions, it is obviously apparent that a person must exit from the compartment 32 as quickly as possible, and this can be accomplished by means of the door 41. In such case, the door 41 also has in a Plexiglass compartment a garment which is visible and suitable directions indicating that this garment can be worn in case of emergencies to exit through the door 41 rather than from exiting therefrom in the nude.

After a person has finished showering, he simply waits until the total ten minutes alloted to the showering operation is timed out after which the computer or control means 60 again energizes the latching means 52, 53 and 54 to unlatch each of these allowing the person within the compartment 32 to enter into the compartment 33. Simultaneously with the unlatching of the latching means 53, a signal from the control means 60 via the circuitry 74 energizes the stepping motor 73 to move the pocket 70 from the area of the second compartment 32 to an area adjacent the door 77, and in this manner, the clothing of the person initially deposited in the pocket at the door 76 follows this person through the shower module 10 and is available at the door 77 at or about the time the person enters into the compartment 33 through the door 36. Obviously, the motor 73 is de-energized by the control means 60 once the particular pocket 70 and the clothes therein have reached the door 77.

After the person enters the compartment 33, he closes the door 36, and this closing is sensed by the detecting means and latching means 53 and communicated to the control means 60 via the circuitry 57. The control means 60 places the circuitry 104 and 105 in electrical communication (not shown) with the source of electrical energy to begin the fan or blower motor 103 and the resistance heaters of the heater 102 and thus hot air A is directed into the compartment 33 through the duct 100 to dry the person therein. The same impulse from the detecting means 53 over the line 57 is interpreted by the control means 60 as indicating that the door 77 can now be opened and thus an impulse over the line 83 opens the latching means 81 so that once the person in the compartment 33 is fully dried, he can then collect his clothes from the now opened door 77, dress and once the full thirty minutes times out and the latching means 52 through 54 are opened by the control means 60 over the respective lines 56, 57 and 58, the person can exit through to the door 37.

It is believed readily apparent from the latter-noted description that since ten minutes are allotted for each of the compartments 31 through 33, persons can be cycled through the shower module 10 on ten minute increments without overlap, jamming up, or one person encountering another person while moving through the doors 34 through 36. Furthermore, the control means 60 may include whatever type of other conventional memory banks or the like are necessary and/or desirable to sophisticate the mechanism 10 beyond that just described, although the latter description represents a preferred operative mode of operation of the shower module 10, although obviously variations thereof will be apparent to those skilled in the art.

The shower module 10 might, of course, be altered in a number of particulars depending upon such factors as the accessibility of power, a water source, or the like. For example, if the shower module 10 is delivered to a site which has no source of water, as is quite possible, then the hot water heater 95 is preferably constructed relatively large so that it performs the dual function of a storage tank which can be precharged with heated water and pressurized prior to the module 10 being delivered to its site. Obviously, the hot water heater or tank 95 is well insulated and if it is precharged and there is no electricity at the site, it need not include a heating element. It simply need be a relatively large storage tank in which is contained pressurized hot water, and a similar tank (not shown) containing pressurized cold water may be used in tandem therewith. In this manner, a pair of tanks might be utilized, and, therefore, the module 10 need not be connected to a source of water supply and for that matter need not even be connected to a source of electrical energy to heat the coil of the water heater 95. Such pressurized water tank, hot, cold or inbetween, is particularly useful in areas where dangerous chemicals are employed and in which the shower module is designed simply as a safety shower should a person be accidentally contaminated or endangered by being splashed or sprayed with such dangerous chemicals. In such cases, obviously the electrical circuitry and associated door locking and unlocking mechanisms might not be utilized, along with the coin operated mode or operation since the desire would be that of simply permitting a contaminated person to enter the shower as immediately as possible for his own personal safety.

It is also in keeping with the present invention that the module 10 can be operated in conjunction with a gasoline energized pump or a gasoline energized generator so that the water in the tank 95 can be pressurized or supplied thereto from a reservoir under pressure and suitable current can be provided for the overall electrical system, respectively. Obviously, in lieu of a gas operated pump or generator, an electrical battery (batteries) can be utilized to operate a pump to pressuize the tank or tanks 95, heat the resistance heater thereof and/or supply power for the overall electricaly system.

Although in a preferred embodiment of the invention as has been specifically illustrated and described herein, it is to be understood that minor variations may be made in the apparatus without departing from the spirit and scope of the invention, as defined in the appended claims.

What is claimed is:

1. A shower module particularly adapted for use at construction sites, campgrounds, industrial plants, truck and auto service stations and the like in which persons can conveniently and efficiently shower comprising partition means for forming three compartments, first door means for entering a first of said compartments within which a person can disrobe, second door means for entering a second of said compartments from said first compartment, means for showering in said second compartment, third door means for entering a third of said compartments from said second compartment, fourth door means for exiting said third compartment, and conveyor means for conveying clothing from said first compartment to said third compartment whereby clothing placed upon said conveyor means by a person when in said first compartment can be reobtained from the conveyor means by the person when in said third compartment.

2. The shower module as defined in claim 1 including control means for operating said conveyor means to move the clothing from the first compartment to the third compartment prior to said first door means being reopened by another person desiring to enter said first compartment.

3. The shower module as defined in claim 1 including means responsive to the opening of said second door means for actuating said conveyor means to move the conveyor means and clothing thereupon in a direction from said first compartment toward said third compartment.

4. The shower module as defined in claim 1 including means for drying a person in said third compartment.

5. The shower module as defined in claim 1 including motor means for driving said conveyor means, control means for selectively operating said motor means, and said control means including first detector means responsive to the opening of said second door means for operating said motor means to drive said conveyor means to move the latter and the clothes therewith in a direction from said first compartment toward said third compartment.

6. The shower module as defined in claim 1 including motor means for driving said conveyor means, control means for selectively operating said motor means, said control means including first detector means responsive to the opening of said second door means for operating said motor means to drive said conveyor means to move the latter and the clothes therewith in a direction from said first compartment toward said third compartment, and second detector means responsive to the opening of said third door means for operating said control means in such a manner that said motor means drive said conveyor to move the latter and the clothes to said third compartment.

7. The shower module as defined in claim 1 including first, second, third and fourth locking means for locking said first through fourth door means respectively, control means for operating said conveyor means to move the clothing from the first compartment to the third compartment prior to said first door means being reopened by another person desiring to enter said first compartment, and said control means operate said first through fourth locking means generally simultaneously between locked and unlocked positions whereby said door means are operable generally simultaneously to permit persons to systematically and successively enter, pass through and exit said first through third compartments.

8. Ths shower module as defined in claim 1 including first, second, third and fourth locking means for locking said first through fourth door means respectively, control means for operating said conveyor means to move the clothing from the first compartment to the third compartment prior to said first door means being reopened by another person desiring to enter said first compartment, said control means operate said first through fourth locking means generally simultaneously between locked and unlocked positions whereby said door means are operable generally simultaneously to permit persons to systematically and successively enter, pass through and exit said first through third compartments, and said control means includes timer means for holding all said first through fourth locking means locked for a predetermined time period.

9. The shower module as defined in claim 1 including control means for operating said conveyor means to move the clothing from the first compartment to the third compartment prior to said first door means being reopened by another person desiring to enter said first compartment, locking means for said first door means connected to said control means for locking and unlocking said first door means, and coin operated mans for actuating said control means and unlock said locking means to permit a person to enter said first compartment through said first door means.

10. The shower module as defined in claim 1 including first, second, third and fourth locking means for locking and unlocking said respective first through fourth door means, control means connected to said first through fourth locking means for selectively operating said first through fourth door means respectively, and coin operated means for actuating said control means and unlock said first locking means to permit a person to enter said first compartment through said first door means.

11. The shower module as defined in claim 1 including first, second, third and fourth locking means for locking and unlocking said respective first through fourth door means, control means connected to said first through fourth locking means for selectively operating said first through fourth door means respectively, coin operated means for actuating said control means and unlock said first locking means to permit a person to enter said first compartment through said first door means, motor means for driving said conveyor means, and said motor means being actuated by said control means to move said conveyor means and clothing thereon from the first compartment toward the third compartment upon the unlocking of said second locking means by said control means whereby a person can enter said second compartment through said second door means during the conveyance of his clothing and prior to the entrance of another person into said first compartment through said first door means.

12. The shower module as defined in claim 1 including first, second, third and fourth locking means for locking and unlocking said respective first through fourth door means, control means connected to said first through fourth locking means for selectively operating said first through fourth door means respectively, coin operated means for actuating said control means and unlock said first locking means to permit a person to enter said first compartment through said first door means, fifth door means in said first compartment for permitting and preventing access to said conveyor means from said first compartment, fifth locking means for locking and unlocking said fifth door means, and said control means being effective for selectively operating said fifth locking means to lock said fifth locking means and thus lock said fifth door means after a person in the first compartment has placed clothing upon the conveyor means through said door means and has closed the latter.

13. The shower module as defined in claim 1 including first, second, third and fourth locking means for locking and unlocking said respective first through fourth door means, control means connected to said first through fourth locking means for selectively operating said first through fourth door means respectively, coin operated means for actuating said control means and unlock said first locking means to permit a person to enter said first compartment through said first door means, fifth door means in said first compartment for permitting and preventing access to said conveyor means from said first compartment, fifth locking means for locking and unlocking said fifth door means, said control means being effective for selectively operating said fifth locking means to lock said fifth locking means and thus lock said fifth door means after a person in the first compartment has placed clothing upon the conveyor means through said door means and has closed the latter, sixth door means in said third compartment for permitting and preventing access to said conveyor means from said third compartment, sixth locking means for locking and unlocking said fifth door means, and said control means being effective for selectively operating said sixth locking means to unlock said sixth locking means and thus unlock said sixth door means after a person in the third compartment has closed said third door means.

14. The shower module as defined in claim 1 including control means for operating said conveyor means to move the clothing from the first compartment to the third compartment generally as a person proceeds from the first compartment to the third compartment.

15. The shower module as defined in claim 1 including control means for establishing a predetermined total period of time between which a person can remain in any one of said compartments, and means in each compartment responsive to said control means for indicating to a person in any one of said compartments that a particular portion of said total period of time remains before the person is to move from the first, second and third compartments to the second and third compartments and exit the third compartment respectively.

16. The shower module as defined in claim 1 including first, second third and fourth locking means for locking and unlocking said first through fourth door means respectively as a person proceeds into, through and out of said first through third compartments, all of said first through fourth locking means being capable of being manually overridden to unlock the same, and emergency door means in said second compartment for directly exiting the latter to the exterior without opening or passing through said second and third door means.

17. The shower module as defined in claim 1 including control means for establishing a predetermined period of time beginning generally with the opening of said first door means whereupon a person first enters the first compartment and ending generally with the opening of said fourth door means whereupon the same last-mentioned person exits the third compartment through said fourth door means.

18. The shower module as defined in claim 1 including control means for establishing a predetermined period of time beginning generally with the opening of said first door means whereupon a person first enters the first compartment and ending generally with the opening of said fourth door means whereupon the same last-mentioned person exits the third compartment through said fourth door means, and coin operated means for actuating said control means to establish said predetermined time period.

19. The shower module as defined in claim 1 including control means for establishing a predetermined period of time beginning generally with the opening of said first door means whereupon a person first enters the first compartment and ending generally with the opening of said first door means whereupon a person first enters the first compartment and ending generally with the opening of said fourth door means whereupon the same last-mentioned person exits the third compartment through said fourth door means, first through fourth locking means for locking and unlocking said first through fourth door means respectively, and said control means operate said first through fourth locking means generally simultaneously between locked and unlocked positions whereby said door means are operable generally simultaneously to permit persons to systematically and successively enter, pass through and exit said first through third compartments.

20. The shower module as defined in claim 1 including control means for establishing a predetermined period of time beginning generally with the opening of said first door means whereupon a person first enters the first compartment and ending generally with the opening of said third door means whereupon the same last-mentioned person exits the third compartment through said fourth door means, coin operated means for actuating said control means to establish said predetermined time period, first through fourth locking means for locking and unlocking said first through fourth door means respectively, and said control means operate said first through fourth locking means generally simultaneously between locked and unlocked positions whereby said door means are operable generally simultaneously to permit persons to systematically and successively enter, pass through and exit said first through third compartments.

21. The shower module as defined in claim 1 including first through fourth locking means for locking and unlocking said first through fourth door means respectively, control means for maintaining said first locking means locked and thus preventing a person from entering said first compartment until a person initially in said first compartment has moved into said second compartment and closed said second door means resulting in the locking of said second locking means, and said control means being further operative for maintaining said third locking means locked and thus preventing a person from entering from said second compartment into said third compartment through said third door means until a person initially in said third compartment has exited therefrom through said fourth door means, thus initially opening said fourth locking means.

22. The shower module as defined in claim 1 including first through fourth locking means for locking and unlocking said first through fourth door means respectively, control means for maintaining said first locking means locked and thus preventing a person from entering said first compartment until a person initially in said first compartment has moved into said second compartment and closed said second door means resulting in the locking of said second locking means, said control means being further operative for maintaining said third locking means locked and thus preventing a person from entering from said second compartment into said third compartment through said third door means until a person initially in said third compartment has exited therefrom through said fourth door means, thus initially opening said fourth locking means, and conveyor means between said first and third compartmens for conveying clothing placed thereon at said first compartment to said third compartment.

23. The shower module as defined in claim 1 including first through fourth locking means for locking and unlocking said first through fourth door means respectively, control means for maintaining said first locking means locked and thus preventing a person from entering said first compartment until a person initially in said first compartment has moved into said second compartment and closed said second door means resulting in the locking of said second locking means, said control means being further operative for maintaining said third locking means locked and thus preventing a person from entering from said second compartment into said third compartment through said third door means until a person initially in said third compartment has exited therefrom through said fourth door means, thus initially opening said fourth locking means, conveyor means between said first and third compartments for conveying clothing placed thereon at said first compartment to said third compartment, and coin operated means for initiating the actuating of said control means to operate said first through fourth locking means.

24. The shower module as defined in claim 1 including first through fourth locking means for locking and unlocking said first through fourth door means respectively, control means for maintaining said first locking means locked and thus preventing a person from entering said first compartment until a person initially in said first compartment has moved into said second compartment and closed said second door means resulting in the locking of said second locking means, said control means being further operative for maintaining said third locking means locked and thus preventing a person from entering from said second compartment into said third compartment through said third door means until a person initially in said third compartment has exited therefrom through said fourth door means, thus initially opening said fourth locking means, conveyor means between said first and third compartments for conveying clothing placed thereon at said first compartment to said third compartment, coin operated means for initiating the actuating of said control means to operate said first through fourth locking means, and said control means establish a predetermined period of time beginning generally with the opening of said first door means whereupon a person first enters the first compartment and ending generally with the opening of said fourth door means whereupon the same last-mentioned person exits the third compartment through said fourth door means.

25. The shower module as defined in claim 1 including control means for establishing a predetermined period of time beginning generally with the opening of said first door means whereupon a person first enters the first compartment and ending generally with the opening of said fourth door means whereupon the same last-mentioned person exits the third compartment through said fourth door means, coin operated means for actuating said control means to establish said predetermined time period, first through fourth locking means for locking and unlocking said first through fourth door means respectively, said control means operate said first through fourth locking means generally simultaneously between locked and unlocked positions whereby said door means are operable generally simultaneously to permit persons to systematically and successively enter, pass through and exit said first through third compartments, and said control means being further operative to control the operation of said conveyor means to move the clothing from the first compartment to the third compartment prior to said first door means being reopened by another person desiring to enter said first compartment.

26. The shower module as defined in claim 1 including control means for establishing a predetermined period of time beginning generally with the opening of said first door means whereupon a person first enters the first compartment and ending generally with the opening of said fourth door means whereupon the same last-mentioned person exits the third compartment through said fourth door means, and coin operated means for actuating said control means to establish said predetermined time period, first through fourth locking means for locking and unlocking said first through fourth door means respectively, said control means operate said first through fourth locking means generally simultaneously between locked and unlocked positions whereby said door means are operable generally simultaneously to permit persons to systematically and successively enter, pass through and exit said first through third compartments, said control means being further operative to control the operation of said conveyor means to move the clothing from the first compartment to the third compartment prior to said first door means being reopened by another person desiring to enter said first compartment, and means for drying a person in said third compartment.

27. The shower module as defined in claim 1 including control means for establishing a predetermined period of time beginning generally with the opening of said first door means whereupon a person first enters the first compartment and ending generally with the opening of said fourth door means whereupon the same last-mentioned person exits the third compartment through said fourth door means, coin operated means for actuating said control means to establish said predetermined time period, first through fourth locking means for locking and unlocking said first through fourth door means respectively, said control means operate said first through fourth locking means generally simultaneously between locked and unlocked positions whereby said door means are operable generally simultaneously to permit persons to systematically and successively enter, pass through and exit said first through third compartments, said control means being further operative to control the operation of said conveyor means to move the clothing from the first compartment to the third compartment prior to said first door means being reopened by another person desiring to enter said first compartment, means for drying a person in said third compartment, motor means for driving said conveyor means, said control means being operative for selectively operating said motor means, and said control means including first detector means responsive to the opening of said second door means for operating said motor means to drive said conveyor means to move the latter and the clothes therewith in a direction from said first compartment toward said third compartment.

28. The shower module as defined in claim 1 including control means for establishing a predetermined period of time beginning generally with the opening of said first door means whereupon a person first enters the first compartment and ending generally with the opening of said fourth door means whereupon the same last-mentioned person exits the third compartment through said fourth door means, coin operated means for actuating said control means to establish said predetermined time period, first through fourth locking means for locking and unlocking said first through fourth door means respectively, said control means operate said first through fourth locking means generally simultaneously between locked and unlocked positions whereby said door means are operable generally simultaneously to permit persons to systematically and successively enter, pass through and exit said first through third compartments, said control means being further operative to control the operation of said conveyor means to move the clothing from the first compartment to the third compartment prior to said first door means being reopened by another person desiring to enter said first compartment, means for drying a person in said third compartment, motor means for driving said conveyor means, said control means being operative for selectively operating said motor means, said control means including first detector means responsive to the opening of said second door means for operating said motor means to drive said conveyor means to move the latter and the clothes therewith in a direction from said first compartment toward said third compartments, and second detector means responsive to the opening of said third door means for operating said control means in such a manner that said motor means drives said conveyor to move the latter and the clothes to said third compartment.

29. The shower module as defined in claim 1 including control means for establishing a predetermined period of time beginning generally with the opening of said first door means whereupon a person first enters the first compartment and ending generally with the opening of said fourth door means whereupon the same last-mentioned person exits the third compartment through said fourth door means, coin operated means for actuating said control means to establish said predetermined time period, first through fourth locking means for locking and unlocking said first through fourth door means respectively, said control means operate said first through fourth locking means generally simultaneously between locked and unlocked positions whereby said door means are operable generally simultaneously to permit persons to systematically and successively enter, pass through and exit said first through third compartments, said control means being further operative to control the operation of said conveyor means to move the clothing from the first compartment to the third compartment prior to said first door means being reopened by another person desiring to enter said first compartment, means for drying a person in said third compartment, motor means for driving said conveyor means, said control means being operative for selectively operating said motor means, said control means including first detector means responsive to the opening of said second door means for operating said motor means to drive said conveyor means to move the latter and the clothes therewith in a direction from said first compartment toward said third compartment, second detector means responsive to the opening of said third door means for operating said control means in such a manner that said motor means drives said conveyor to move the latter and the clothes to said third compartment, said control means further establish a predetermined period of time beginning generally with the opening of said first door means whereupon a person first enters the first compartment and ending generally with the opening of said third door means whereupon the same last-mentioned person exits the third compartment through said fourth door means, and coin operated means for actuating said control means to establish said predetermined time period.

* * * * *